US005629501A

United States Patent [19]

Fenton

[11] Patent Number: 5,629,501

[45] Date of Patent: May 13, 1997

[54] COMPOSITE SPEAKER SYSTEM HAVING A DIRECTIONAL ADJUSTABLE TRANSDUCER

[76] Inventor: Robert Fenton, 28003 W. Via Amistosa, Agoura Hills, Calif. 91301

[21] Appl. No.: 533,015

[22] Filed: Sep. 25, 1995

Related U.S. Application Data

[63] Continuation-in-part of Ser. No. 264,739, Jun. 23, 1994, Pat. No. 5,512,714.

[51] Int. Cl.[6] ..... H04R 15/00

[52] U.S. Cl. ..... 181/144; 181/163; 381/186

[58] Field of Search ..... 181/144, 150, 181/154, 163, 199, 141; 381/184, 185, 186, 86

[56] References Cited

U.S. PATENT DOCUMENTS

| | | | |
|---|---|---|---|
| 2,231,479 | 2/1941 | Perry . | |
| 3,213,209 | 10/1965 | Doelitzsch . | |
| 3,379,276 | 4/1968 | Goettl . | |
| 3,754,618 | 8/1973 | Sasaki . | |
| 4,182,429 | 1/1980 | Senzaki . | |
| 4,365,114 | 12/1982 | Soma . | |
| 4,492,826 | 1/1985 | Chiu | 381/186 |
| 4,552,242 | 11/1985 | Kashiwabara | 181/144 |
| 4,553,630 | 11/1985 | Ando | 181/144 |
| 4,554,414 | 11/1985 | House . | |
| 4,811,406 | 3/1989 | Kawachi | 381/186 |
| 5,133,428 | 7/1992 | Perrson . | |

*Primary Examiner*—Khanh Dang
*Attorney, Agent, or Firm*—Thomas I. Rozsa; Tony D. Chen

[57] ABSTRACT

A composite speaker system including a high frequency transducer and a low frequency transducer. An adjustable rod is attached to a pole piece of the low frequency transducer and a back side of the high frequency transducer. The high frequency transducer can be adjusted in any direction to improve the sound quality because the listener can actually aim the high frequency transducer at himself or herself and the composite speaker system can be mounted anywhere in a vehicle or room.

14 Claims, 5 Drawing Sheets

COMPOSITE SPEAKER SYSTEM HAVING A DIRECTIONAL ADJUSTABLE TRANSDUCER

This application is a Continuation-In-Part of the patent application Serial No. 08/264,739 filed on Jun. 23, 1994, now U.S. Pat. No. 5,512,714.

BACKGROUND OF THE INVENTION

1. Field of The Invention

The present invention generally relates to the field of electrodynamic speakers. More particularly, the present invention relates to the field of directional adjustable audio speaker systems for automotive vehicles.

2. Description of The Prior Art

Generally, audio speaker systems are well known in the art. These speaker systems cannot always be mounted in the ideal location in vehicles because most factory speakers are mounted in the vehicle's doors, and most aftermarket replacement speakers are mounted in the same spot and therefore do not improve the sound quality of the speaker.

In some prior art applications, a tweeter is mounted into a housing which is mounted to the speaker and is flush with the grill. The disadvantage with this prior art design is that when the tweeter swivels in the housing, the tweeter is partially blocked by its own housing and the quality of the sound is distorted. Another disadvantage is that the tweeter can only swivel to a certain degree because of the constraints at the periphery of the housing. In another prior art design, the tweeter is mounted on the grill and is rotatable by loosening or tightening a knob. The disadvantage of this design is that it cannot be used with existing grills that are already mounted in the vehicle.

The following eight (8) prior art patents were uncovered in the pertinent field of the present invention.

1. U.S. Pat. No. 2,231,479 issued to Perry on Feb. 11, 1941 for "Signal Translating Apparatus" (hereafter "the Perry Patent").

2. U.S. Pat. No. 3,213,209 issued to Doelitzsch on Oct. 19, 1965 for "Loudspeaker" (hereafter "the Doelitzsch Patent").

3. U.S. Pat. No. 3,379,276 issued to Goettl on Apr. 23, 1968 for "Speaker Installation Means" (hereafter "the Goettl Patent").

4. U.S. Pat. No. 3,754,618 issued to Sasaki on Aug. 28, 1973 for "Speaker System" (hereafter "the Sasaki Patent").

5. U.S. Pat. No. 4,182,429 issued to Senzaki on Jan. 8, 1980 for "Loud-Speaker System" (hereafter "the Senzaki Patent").

6. U.S. Pat. No. 4,365,114 issued to Soma on Dec. 21, 1982 for "Automotive Loudspeaker Having Variable Speaker Orientation And Particular Electrical Connections" (hereafter "the Soma Patent").

7. U.S. Pat. No. 4,554,414 issued to House on Nov. 19, 1985 for "Multi-Driver Loudspeaker" (hereafter "the House Patent").

8. U.S. Pat. No. 5,133,428 issued to Perrson on Jul. 28, 1992 for "Direction-Adjustable Speaker System" (hereafter "the Perrson Patent").

The Perry Patent discloses a signal translating apparatus. It includes a large conical diaphragm adapted to particularly radiate the lower frequencies and a small diaphragm nested concentrically with the large diaphragm and adapted to particularly radiate the higher frequencies. The Perry Patent does not have an adjustable means.

The Doelitzsch Patent discloses a loudspeaker. It includes a woofer cone and a tweeter cone. A voice coil is mounted to an elongated tube and the tweeter cone is permanently mounted to the forward end of the tube. The Doelitzsch Patent is a conventional loudspeaker which does not have an adjustable means.

The Goettl Patent discloses a speaker installation means. It includes a triangular frame which is disposed to close a corner recess of a building room, ceiling and wall structure. The frame provides an adjustably supported means for supporting a speaker therein. The perimeter of the speaker does not extend out from the frame.

The Sasaki Patent discloses a speaker system. A speaker box is supported within a frame body by shafts provided at the right and left sides, so that the speaker box is allowed to rotate around the horizontal extended shafts and a middle range speaker and a tweeter are included in the speaker box mounted on a baffle. This has the same disadvantage as mentioned above, where the speaker box is rotated within the frame body and is partially blocked by its own housing and the quality of the sound is distorted. This is a home unit and does not relate to car speakers.

The Senzaki Patent discloses a loud speaker system. It includes a woofer speaker and a tweeter speaker which is disposed substantially coaxially to the woofer speaker. The tweeter is mounted to a support plate which is disposed within the opening of the woofer speaker. The pivotal movement of the support plate is carried out stepwise by the alternate engagement of balls held in holes formed in the web portions of the bridge members with the detents formed in the side plate portions of the support plate.

The Soma Patent discloses a composite speaker system for automotive vehicles. It includes a low range speaker unit, a medium or high range speaker unit and an attachment member. The attachment member is attachable to and detachable from an outer peripheral portion of a frame member and provides a protection to the open surface of the low range speaker. The attachment member includes an annular ring portion, a hub portion and spokes which radially extend from the hub portion to the inside wall of the annular ring portion. The medium speaker unit is coupled to the hub portion of the attachment member. The medium speaker can be varied in the vertical direction by adjustment of a knob. Upon loosening the knob, the medium speaker can be rotated about the knob whereas by tightening the knob, the medium speaker can be secured at any possible position. In the second embodiment of the Soma Patent, the medium speaker is designed to be rotatable in the horizontal and the vertical plane.

The House Patent discloses a multi-driver loudspeaker. It includes a woofer speaker and a tweeter speaker which is mounted within the woofer speaker. The tweeter cone is suspended in front of the woofer cone in several ways. The tweeter perimeter can be attached to the woofer cone directly, or through a compliant member. The tweeter cone can be suspended in front of the woofer cone, with no physical contact between the cones, by supporting the tweeter cone from its crystal driver and attaching the crystal driver directly to the voice coil form of the woofer. The mounting structure permits orientation of the tweeter speaker axis at an angle to the axis of the woofer speaker. In the House Patent, the conventional pole piece which supports the tweeter speaker is eliminated.

The Perrson Patent discloses a direction adjustable speaker system. It teaches a swivel speaker system to custom aim sound emanating from the speaker. It includes a sound driver which is secured within a rotatable mount, which is itself secured within a housing by means of a retainer. The disadvantage in this design is that the sound emanating from the tweeter is partially blocked by the housing.

It will be desireable to design a novel composite speaker system for automotive vehicles in which a tweeter is mounted to an adjustable flexible arm which is mounted to a speaker, so that a listener can adjust the tweeter to improve the sound quality because the tweeter can be aimed at the listener in the vehicle.

SUMMARY OF THE INVENTION

The present invention is a novel and unique composite speaker system which relates to existing aftermarket replacement speakers. The composite speaker system has an adjustable tweeter mounted within a woofer or the like.

The object of the present invention is to have a tweeter or high frequency transducer attached to an adjustable flexible arm or arms which is mounted to the pole piece or adapter member connected to the pole piece of a woofer or low frequency transducer. This design will make it a coaxial, two-way type speaker with an adjustable tweeter. A listener can adjust the tweeter to improve the sound quality because the listener can actually aim the tweeter at himself or herself and the composite speaker system can be mounted anywhere in the car, for example factory locations such as in the vehicle's doors. This aiming capability gives the listener up-front and live-performance sound.

The present invention can also used with a midrange speaker in a three or four way type configuration speaker system.

It is therefore an object of the present invention to provide a composite speaker system particularly suitable for automotive vehicles in which a woofer or low frequency transducer is mounted to a door of the vehicle while a tweeter or high frequency transducer is mounted within the woofer and is freely adjustable in any direction to precisely aim sound radiating from the tweeter towards a listener.

It is also an object of the present invention to provide a composite speaker system which includes an adjustable flexible arm or arms made of flexible metal material which is attached to an elongated cylindrical shaped adapter means such that the adapter means can be mounted to a pole piece of a woofer, so that a tweeter can be attached to the adjustable flexible arm, and the direction of the sound radiating from the tweeter can be adjusted by adjusting the adjustable flexible arm.

It is a further object of the present invention to provide an elongated adapter means which has a wide flat platform top end so that two or three adjustable tweeters or transducers can be attached to the platform to provide a two or three way type configuration speaker system.

It is an additional object of the present invention to provide a single assembly having a combination of two or more tweeters or transducers in which the high frequency transducers are mounted with respect to the low frequency transducer.

It is still a further object of the present invention to provide a composite speaker system which comprises an adjustable rod which at one end is directly attached to a pole piece of a low frequency transducer and at the other end is adjustably attached to a high frequency transducer, so that the high frequency transducer can swivel freely around in any direction for providing an aiming capability, thereby giving the listener up-front and live-performance sound.

It is another object of the present invention to provide a composite speaker system which comprises an adjustable rod which at one end is adjustably attached to a pole piece of a low frequency transducer and at the other end is fixedly attached to a high frequency transducer, so that the high frequency transducer can be tilted in any direction by tilting the adjustable rod for providing an aiming capability, thereby giving the listener up-front and live-performance sound.

It is still further another object of the present invention to provide a composite speaker system which comprises an adjustable rod which at one end is adjustably attached to a pole piece of a low frequency transducer and at the other end is adjustably attached to a high frequency transducer, so that the high frequency transducer can swivel freely around in any direction and also be tilted in a desired direction by tilting the adjustable rod for providing an aiming capability, thereby giving the listener up-front and live-performance sound.

It is still further another object of the present invention to provide a composite speaker system which comprises a fixed rod means having one end attached to a pole piece of a low frequency transducer and at the other end is attached to a high frequency transducer, so that the high frequency transducer is fixed in a desired direction for providing an aiming capability, thereby giving the listener up-front and live-performance sound.

In one embodiment of the present invention, the composite speaker system includes a tweeter or high frequency transducer and a woofer or low frequency transducer. The tweeter is attached to an adjustable flexible arm which is mounted to an elongated adapter means. The adapter means is mounted to a pole piece of the woofer, so that the tweeter can easily be adjusted in any direction to improve the sound quality of the composite speaker system.

In another embodiment of the present invention, the composite speaker system includes a tweeter and a woofer. An elongated arm has ball joints at one or both ends and are respectively attached to the tweeter and an adapter means.

In a further embodiment of the present invention, the composite speaker system includes multiple tweeters or transducers, a woofer and an adapter means which has a wide flat platform. The transducers are attached to adjustable flexible arms which are mounted to the platform of the adapter means. The adapter means is then mounted to a pole piece of the woofer.

In an additional embodiment of the present invention, the composite speaker system includes a tweeter and a woofer. The tweeter is attached to an adjustable flexible arm which is directly mounted to an extended pole piece of the woofer.

In a further additional embodiment of the present invention, the composite speaker system includes a tweeter, a woofer and an elongated rod. The tweeter is attached to an adjustable flexible arm which is mounted to an adapter means which is in turn mounted to the pole piece of the woofer. The elongated rod is attached to the side of the tweeter and extends outwardly through an enlarged slot aperture on a grill member so that a listener can easily adjust the tweeter without removing the grill member from the woofer.

In general, the uniqueness of the present invention is that the aiming capability gives the listener up-front and live-performance sound radiating from he tweeter towards the listener.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
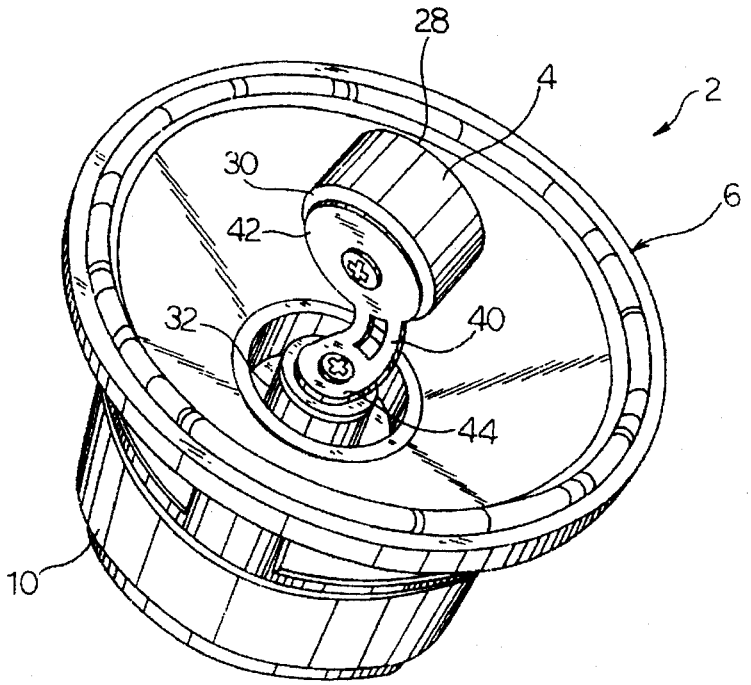
FIG. 1 is a perspective view of one embodiment of the present invention composite speaker system having a directional adjustable tweeter and a woofer (for clarity the grill member is not shown).
Figure 2:
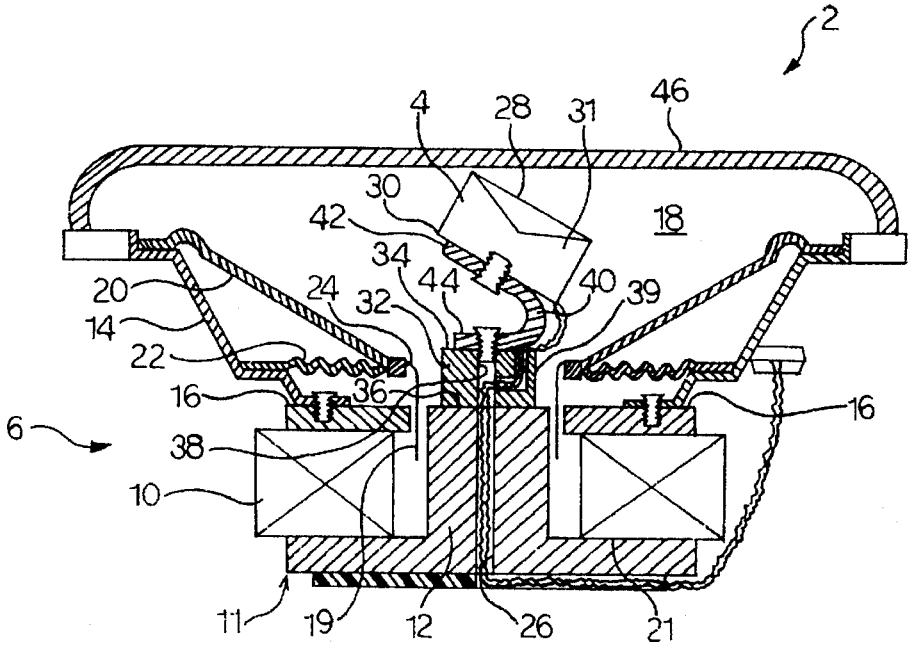
FIG. 2 is a cross-sectional view of the embodiment shown in FIG. 1, where a tweeter is attached to an adjustable flexible arm which is mounted to an elongated adapter means which in turn is mounted to a pole piece of a woofer.

FIGS. 1 and 2 illustrate one embodiment of the present invention composite speaker system 2. Referring to FIGS. 1 and 2, there is shown the composite speaker system 2 which represents a system of the coaxial, two way type configuration. The composite speaker system 2 includes a tweeter or high frequency transducer 4 and a woofer or low frequency transducer 6. The woofer 6 is for reproducing low frequency sounds which is of the well known permanent-magnet, moving coil type comprising a magnet circuit 11, a magnet 10, a bottom plate 21, a pole piece 12 and a top plate 16. A frame 14 is secured to the top plate 16. The frame 14 has a generally conical configuration and defines an open space 18 which is also generally the frontal area of the woofer 6. The shape of the open space 18 formed by the frame 14 can be other than circular shaped, such as oval shaped. A damper or spider 22 has an outer edge which is mounted to the frame 14 and an inner edge which is coupled to an inner edge of a diaphragm 20. The diaphragm 20 extends or flares generally conically outwardly and has its outer edge secured to the periphery of the frame 14. Both the damper 22 and the diaphragm 20 are mounted within the open space 18 of the frame 14. The coupled inner edges of the damper 22 and the diaphragm 20 form a central opening 24. A central portion of the diaphragm 20 is attached to a voice coil bobbin 19 which carries a voice coil (not shown). The pole piece 12 has an opening 26 therethrough. Up to this point of the description, the construction of the woofer 6 is essentially conventional.

The tweeter 4 is for reproducing high frequency sounds. The tweeter 4 includes a front side 28, a back side 30 and a diaphragm 31, the central axis of which can be aligned with the central axis of the diaphragm 20 of the woofer 6 or off the central axis of the diaphragm 20 of the woofer 6. The diaphragm 31 of the tweeter 4 has a substantially smaller dimension than that of the diaphragm 20 of the woofer 6. The electrical wiring of the tweeter 4 is wired in an essentially conventional manner.

The present invention utilizes an elongated cylindrical shaped adapter member 32 or supporting structure which has a top end 34, a bottom end 36, a central opening 38 extending from the top end 34 to the bottom end 36 and a small aperture 39 located at the top end 34 off center and adjacent to the central opening 38. The small aperture 39 extends downwardly and intersects with the central opening 38 at a midpoint location on the adapter member 32 for allowing electrical wires of the tweeter 4 to be inserted through the bottom end 36 and the opening 26 of the pole piece 12 and be connected to input terminals mounted upon a portion of the frame 14. The opening 38 of the adapter member 32 is aligned with the central opening 26 on the pole piece 12 and fixedly secured thereto by adhesive or epoxy means. The top end 34 of the adapter member 32 extends above the central opening 24 formed by the inner edges of the diaphragm 20 and the damper 22 of the woofer 6.

An elongated adjustable flexible arm or arms 40 has one end 42 attached to the back side 30 of the tweeter 4 and the other end 44 being aligned with the central opening 38 at the top end 34 of the elongated adapter member 32 and threadedly secured thereto by a threaded screw or adhesive means, such that the tweeter 4 can easily be adjusted in any direction within the open space 18 of the woofer 6. The adjustable arm member 40 is covered by an insulating material.

A grill member 46 made of metal or plastic material is detachably attached on an outer peripheral portion of the frame 14. The grill member 46 is provided for the purpose of covering the open space 18 of the woofer 6 and the tweeter 4. The composite speaker system 2 can be used without the grill member 46 as shown in FIG. 1 or it can be used with a factory grill that is already utilized in the automobile. One uniqueness of the present invention is that the tweeter is completely covered within the grill member 46 which can be of conventional shape and size. In other words, no enlarged or special shaped grill is needed to cover the woofer 6 and the tweeter 4.

The adjustable flexible arm 40 can be made from several materials. The manufacturing process which could accommodate the construction of the adjustable flexible arm 40 may be injection, thermoform, etc. or other molding process. By way of example only, the adjustable flexible arm 40 can be made of flexible metal material. It may be made of other flexible materials such as elastic synthetic rubber or the like. The tweeter 4 and the woofer 6 conform to conventional forms of manufacture.

Once the tweeter 4 is mounted within the open space 18 of woofer 6, the tweeter 4 can easily be adjusted in any direction for providing an aiming capability, thereby giving the listener up-front and live-performance sound.

It will be appreciated that the present invention is not limited to the composite speaker system for automotive vehicles. It is emphasized that while the present invention can be used in automotive vehicles, it is also within the spirit and scope of the present invention to utilize the adjustable flexible arm for speakers in home speaker systems.

Figure 3:
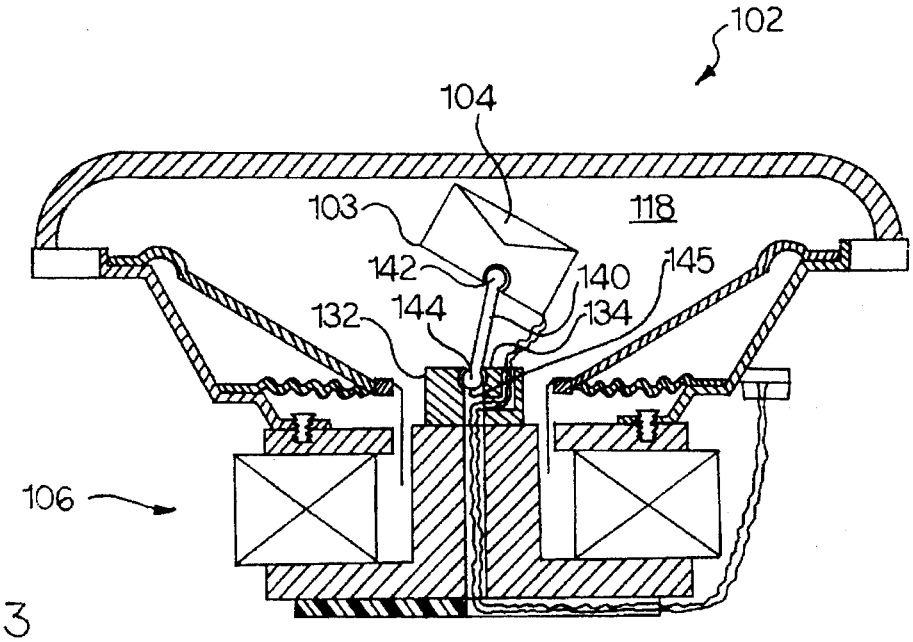
FIG. 3 is a cross-sectional view of another embodiment of the present invention composite speaker system having a tweeter which utilizes ball joints with an adjustable arm means attached to an elongated adapter means which is mounted to a pole piece of a woofer.

Referring to FIG. 3, there is shown a cross-sectional view of another embodiment of the present invention composite speaker system 102. It assembles and functions the same as previously described above except that an elongated rod 140 is substituted for the adjustable flexible arm 40. All other components are the same as previously described in FIGS. 1 and 2, and the description thereof will not be repeated and only the modified components will be described in detail. In this figure, the components are numbered correspondingly with 100 added to each number.

The elongated rod 140 has a ball joint end 142 attached to the back side 130 of the tweeter 104 and an opposite ball joint end 144 mounted at the top end 134 of the elongated adapter member 132 and secured thereto by a socket joint 145, and thereby the tweeter 104 can be adjusted in any direction within the open surface 118 of the woofer 106. The elongated rod 140 may be covered by an insulation material. One of the ball joints 142 or 144 may be eliminated as a simplified embodiment.

Figure 4:
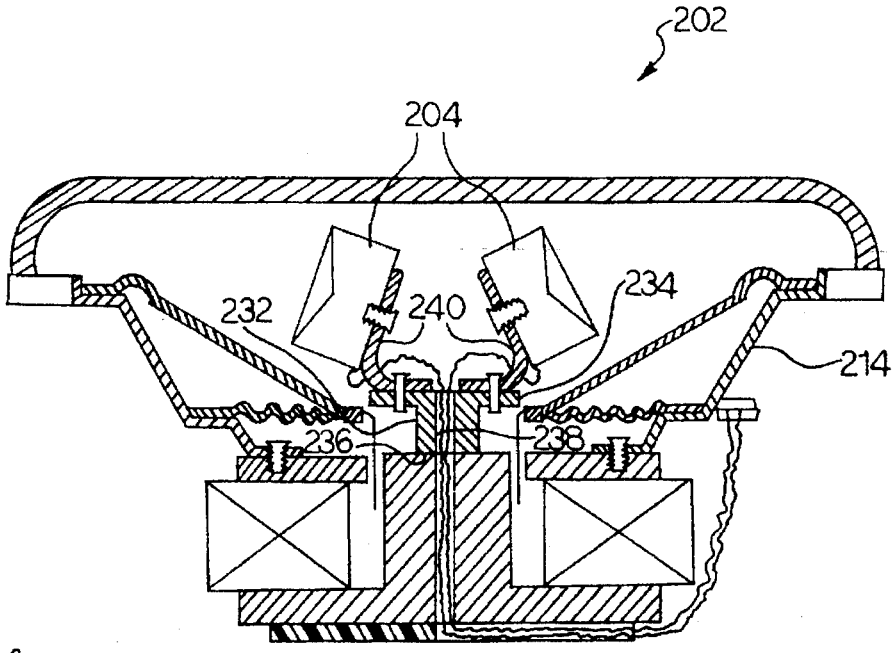
FIG. 4 is a cross-sectional view of still another embodiment of the present invention composite speaker system having multiple tweeters or transducers which are mounted to a wide flat platform on top of an adapter means which is in turn mounted to a pole piece of a woofer.

Referring to FIG. 4, there is shown a cross-sectional view of still another embodiment of the present invention composite speaker system 202 which represents a system of the triaxial, three-way type configuration. It assembles and functions the same as previously described in FIGS. 1 and 2, except that the elongated adapter member 232 has a platform top end 234 for adapting multiple tweeters or transducers. All other components are the same, and the description thereof will not be repeated and only the modified components will be described in detail. In this figure, the components are numbered correspondingly with 200 added to each number.

The platform top end 234 has a generally wide flat top which is utilized for mounting a plurality of tweeters or transducers 204. Only two transducers 204 are illustrated in this figure for the purpose of clarity. The elongated adapter member 232 has a central opening 238 extending through from the top end 234 to the bottom end 236 for the purpose of inserting and connecting the electrical wires from the transducers 204 to the input terminals mounted on the frame 214. Each transducer 204 will be mounted with an adjustable flexible arm 240 such that each transducer 204 can easily be adjusted individually in any direction for providing an aiming capability, thereby giving the listener up-front and live-performance sound. The plurality of transducers 204 can be a combination of tweeters and midrange speakers, or it can be a plurality of tweeters or a plurality of midrange speakers.

It will be appreciated that the present invention is not limited to the coaxial and triaxial types of configurations. It is also within the spirit and scope of the present invention to have quadriaxial, etc., types of configuration.

Figure 5:
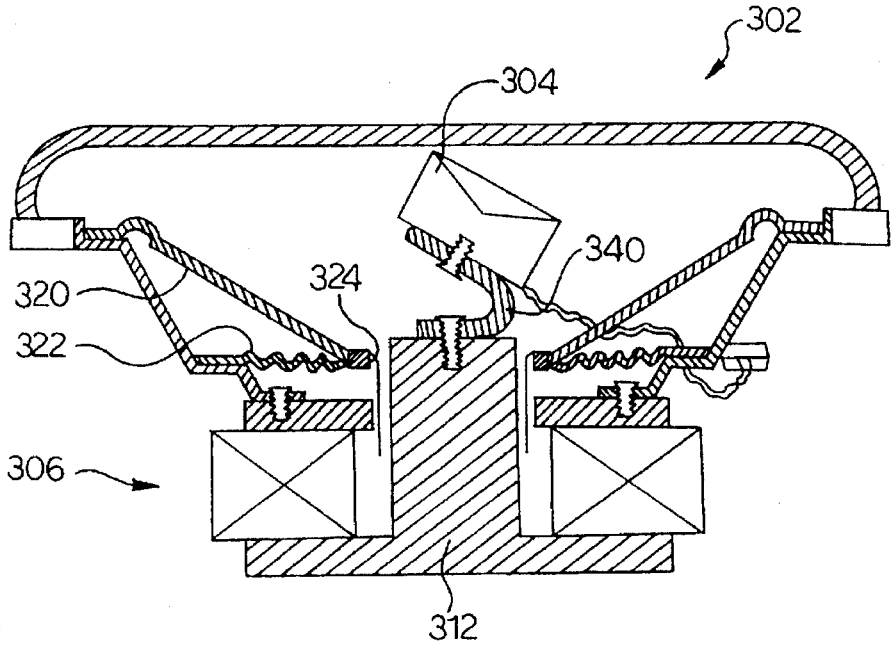
FIG. 5 is a cross-sectional view of a further embodiment of the present invention composite speaker system having a tweeter which is attached to an adjustable flexible arm which is in turn directly mounted to an extended pole piece of a woofer.

Referring to FIG. 5, there is shown a cross-sectional view of a further embodiment of the present invention composite speaker system 302. In this embodiment, the elongated adapter member 32 shown in FIGS. 1 and 2 is not utilized. All other components are the same, and the description thereof will not be repeated and only the modified components will be described in detail. In this figure, the components are numbered correspondingly with 300 added to each number.

In this embodiment, an extended pole piece 312 is utilized and extends upwardly above the central opening 324 formed by the inner edges of the damper 322 and the diaphragm 320 of the woofer 306. The adjustable flexible arm 340 is directly mounted to the extended pole piece 312. The flexible electrical wiring of the tweeter 304 is attached through the diaphragm 320 of the woofer 306 in a conventional manner.

Figure 6:
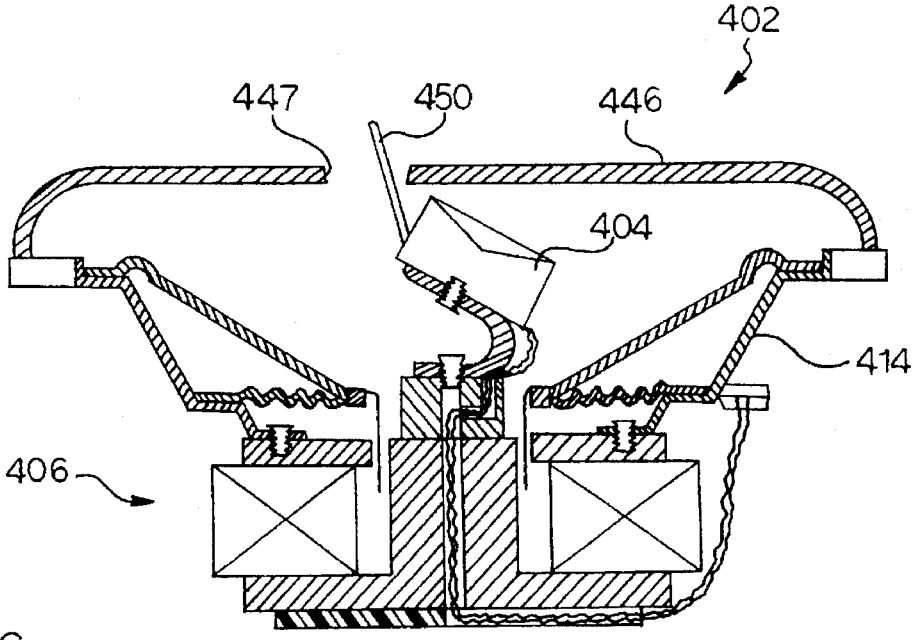
FIG. 6 is a cross-sectional view of an additional embodiment of the present invention composite speaker system having a tweeter mounted within a woofer and is adjusted by an elongated rod extending through a slot aperture on a grill.

Referring to FIG. 6, there is shown a cross-sectional view of an additional embodiment of the present invention composite speaker system 402. In this embodiment, the tweeter 404 and the grill member 446 are modified. All other components are the same as previously described in FIGS. 1 and 2, and the description thereof will not be repeated and only the modified components will be described in detail. In this figure, the components are numbered correspondingly with 400 added to each number.

An elongated rod 450 is attached to a side of the tweeter 404 for the purpose of adjusting the tweeter 404 when the grill member 446 is mounted on the frame 414. The grill member 446 has an enlarged slot aperture 447 for allowing the elongated rod 450 to extend out from the woofer 406 and to move side to side, or forward and backward or any other direction, and thereby the tweeter 404 can easily be adjusted in any direction by moving the elongated rod 450 without removing the grill member 446 from the frame 414.

Figure 7:
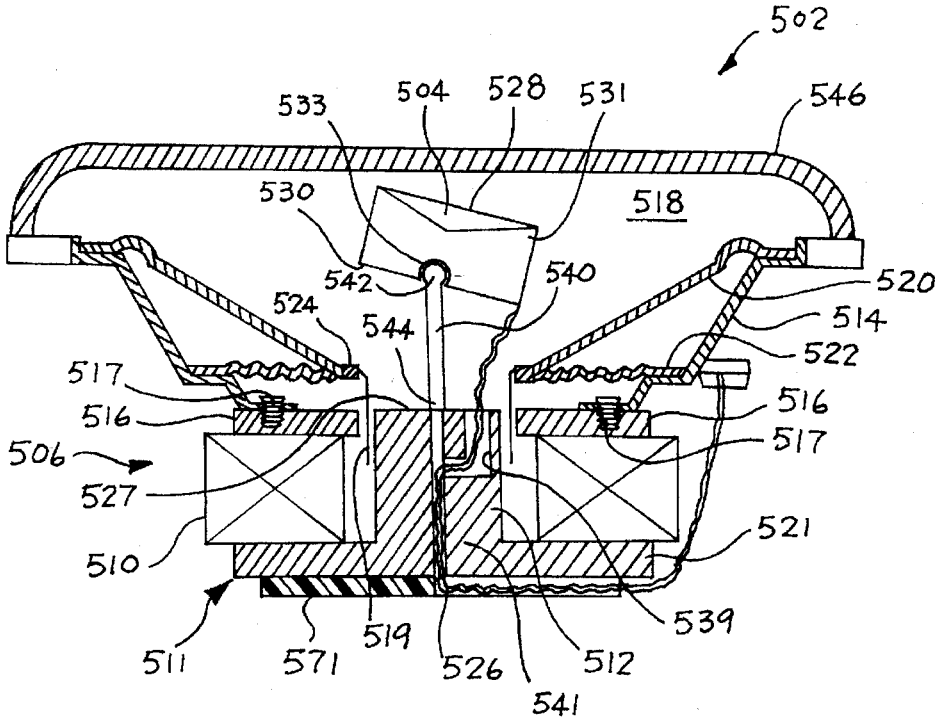
FIG. 7 is a cross-sectional view of still another embodiment of the present invention composite speaker system, showing an adjustable arm means with at one end a ball joint adjustably attached to a smaller transducer and the other end fixedly mounted to a pole piece of a larger transducer.

Referring to FIG. 7, there is shown at 502 a cross-sectional view of still another embodiment of the present invention composite speaker system which represents a system of the coaxial, two way type configuration. The composite speaker system 502 comprises a high frequency smaller transducer 504 and a low frequency larger transducer 506. The larger transducer 506 is for reproducing low frequency sounds which is of the well known permanent-magnet, moving coil type comprising a magnet circuit 511, a magnet 510, a bottom plate 521, a pole piece 512 and a top plate 516. A frame 514 is secured to the top plate 516 by various types of means such as adhesive or screw means 517 as illustrated. The frame 514 has a generally conical configuration and defines an open space 518 which is also generally the frontal area of the larger transducer 506. The shape of the open space 518 formed by the frame 514 can be other than circular shaped, such as oval shaped. A damper or spider 522 has an outer edge which is mounted to the frame 514 and an inner edge which is coupled to an inner edge of a diaphragm 520. The diaphragm 520 extends or flares generally conically outwardly and has its outer edge secured to the periphery of the frame 514. Both the damper 522 and the diaphragm 520 are mounted within the open space 518 of the frame 514. The coupled inner edges of the damper 522 and the diaphragm 520 form a central opening 524. A central portion of the diaphragm 520 is attached to a voice coil bobbin 519 which carries a voice coil (not shown). Up to this point of the description, the construction of the larger transducer 506 is essentially conventional in the art.

The pole piece 512 of the larger transducer 506 has a central opening 526 therethrough. The pole piece 512 further has a small aperture 539 which extends downwardly and intersects with the central opening 526 for routing electrical wires 541 of the smaller transducer 504. The electrical wires 541 are inserted through the small aperture 539 and into the opening 526 of the pole piece 512 and connected to input terminals mounted upon a portion of the frame 514 of the larger transducer 506.

Figure 8:
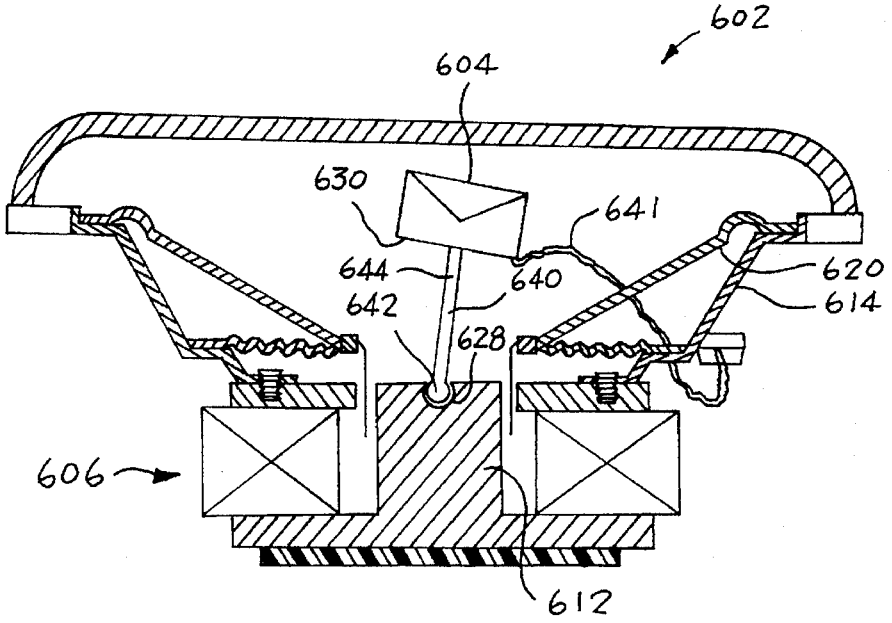
FIG. 8 is a cross-sectional view of still further another embodiment of the present invention composite speaker system, showing an adjustable arm means with a ball joint end adjustably mounted to a pole piece of a larger transducer and the other end fixedly attached to a smaller transducer.

It will be appreciated that the smaller transducer 504 may be conventionally connected to the input terminals of the larger transducer 506. By way of example, the electrical wires may pass through the diaphragm 520 and the frame 514 of the larger transducer 506 as shown in FIG. 8.

The smaller transducer 504 is for reproducing high frequency sounds and is conventional in the art. The small transducer 504 comprises a front side 528, a back side 530, a socket joint connection 533 located on the back side 530, and a diaphragm 531, the central axis of which can be aligned with the central axis of the diaphragm 520 of the larger transducer 506 or off the central axis of the diaphragm 520 of the larger transducer 506. The diaphragm 531 of the smaller transducer 504 has a substantially smaller dimension than that of the diaphragm 520 of the larger transducer 506.

An elongated adjustable rod 540 has one end with a ball joint 542 and the other end 544 affixed to top 527 of the pole piece 512 and above the opening 526. The rod 540 may be affixed to the pole piece 512 by adhesive means or by threaded means such that the rod 540 is in the vertical direction. The ball joint end 542 is adjustably set within the socket joint connection 533 of the smaller transducer 504 such that the smaller transducer 504 can swivel freely around within the open space 518. The adjustable rod 540 may be covered by an insulating material for preventing electrical shorts.

A grill member 546 made of metal or plastic material is detachably attached on an outer peripheral portion of the frame 514. The grill member 546 is provided for the purpose of covering the open space 518 of the larger transducer 506 and the smaller transducer 504. The composite speaker system 502 can be used without the grill member 546 or it can be used with a factory grill that is already utilized in the vehicle. One uniqueness of the present invention is that the smaller transducer 504 is completely covered by the grill member 546 which can be of conventional shape and size. In other words, no enlarged or special shaped grill is required.

A rubber or plastic pad 571 is also provided to the larger transducer 506 and is attached to the bottom plate 521. Although, the pad 571 is not required in the present invention composite speaker system 502, it simply serves to protect the electrical wires 541.

The smaller and the larger transducers 504 and 506 conform to conventional forms of manufacture. Once the smaller transducer 504 is mounted within the open space 518 of the larger transducer 506, the smaller transducer 504 can easily be adjusted in any direction for providing an aiming capability, thereby giving the listener up-front and live-performance sound.

It will be appreciated that the present invention is not limited to the composite speaker system for automotive vehicles. It is emphasized that while the present invention can be used in automotive vehicles, it is also within the spirit and scope of the present invention to utilize the elongated adjustable rod for speakers in home speaker systems.

Referring to FIG. 8, there is shown at 602 a cross-sectional view of still further another embodiment of the present invention composite speaker system which represents a system of the coaxial, two way type configuration. It assembles and functions the same as previously described above in FIG. 7 except that the elongated adjustable rod 640 is adjustably mounted to the pole piece 612. All other components are the same as previously described in FIG. 7, and the description thereof will not be repeated and only the modified components will be described in detail. In this figure, the components are numbered correspondingly with 600 added to each number.

For simplicity of this embodiment, the pole piece 612 of the larger transducer 606 does not have a central opening therethrough, as shown in FIG. 7. However, the pole piece 612 may be produced as shown in FIG. 7. The pole piece 612 does have a central socket joint 628. Electrical wires 641 are passed through the diaphragm 620 and the frame 614 of the larger transducer 606 in the conventional way and connected to input terminals of the larger transducer 606. An elongated adjustable rod 640 has one end with a ball joint 642. The ball joint end 642 is adjustably set within the socket joint connection 628 on the pole piece 612. The other end 644 of the adjustable rod 640 is attached to a back side 630 of the smaller transducer 604 such that the smaller transducer 604 can be tilted at an angle by tilting the adjustable rod 640 at an angle. The other end 644 is conventionally attached to the back side 630 of the smaller transducer 604 by adhesive means, threaded screw means or any other conventional way known to one skilled in the art.

Figure 9:
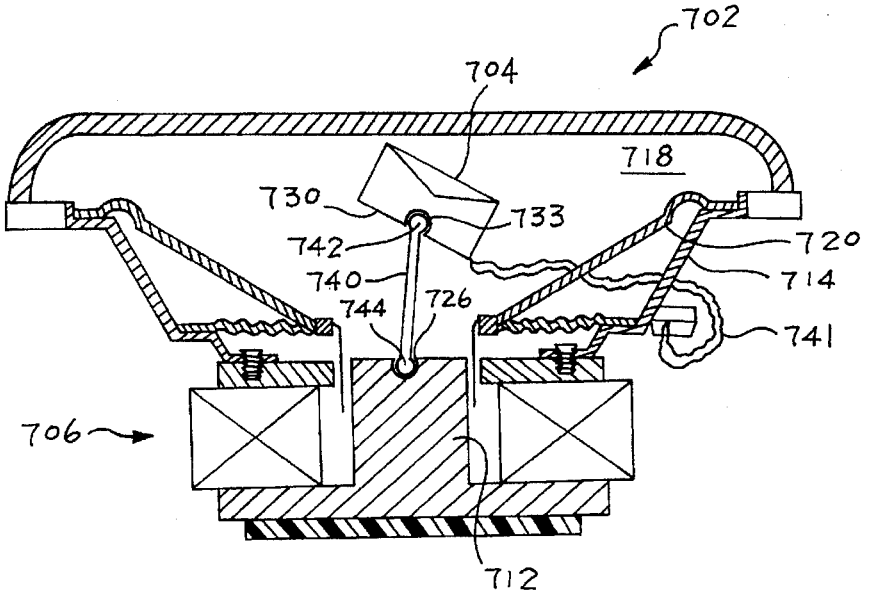
FIG. 9 is a cross-sectional view of still further another embodiment of the present invention composite speaker system, showing an adjustable arm means with two ball joint ends adjustably attached to a smaller transducer and a pole piece of a larger transducer respectively.

Referring to FIG. 9, there is shown at 702 a cross-sectional view of still further another embodiment of the present invention composite speaker system which represents a system of the coaxial, two way type configuration. It assembles and functions the same as previously described above in FIG. 7 and 8 except that the elongated adjustable rod 740 is adjustably mounted to the smaller transducer 704 and the pole piece 712. All other components are the same as previously described in FIG. 7, and the description thereof will not be repeated and only the modified components will be described in detail. In this figure, the components are numbered correspondingly with 700 added to each number.

For simplicity of this embodiment, the pole piece 712 of the larger transducer 706 does not have a central opening therethrough, as shown in FIG. 7. However, the pole piece 712 may be produced as shown in FIG. 7, but for this embodiment the pole piece 712 has a central socket joint connectioin 726. Electrical wires 741 are electrically connected by passing through the diaphragm 720 and the frame 714 of the larger transducer 706 in the conventional way and connected to input terminals of the larger transducer 706.

An elongated adjustable rod 740 has one end with a ball joint 742 and the other end also has a ball joint 744. The ball joint end 742 is adjustably set within a socket joint connection 733 on a back side 730 of the smaller transducer 704.

The ball joint end 744 is also adjustably set within the socket joint connection 728 on the pole piece 712. The smaller transducer 704 can swivel freely around within the open space 718 while the elongated adjustable rod 740 can be tilted. One of the ball joints 742 or 744 may be eliminated as a simplified embodiment.

Figure 10:
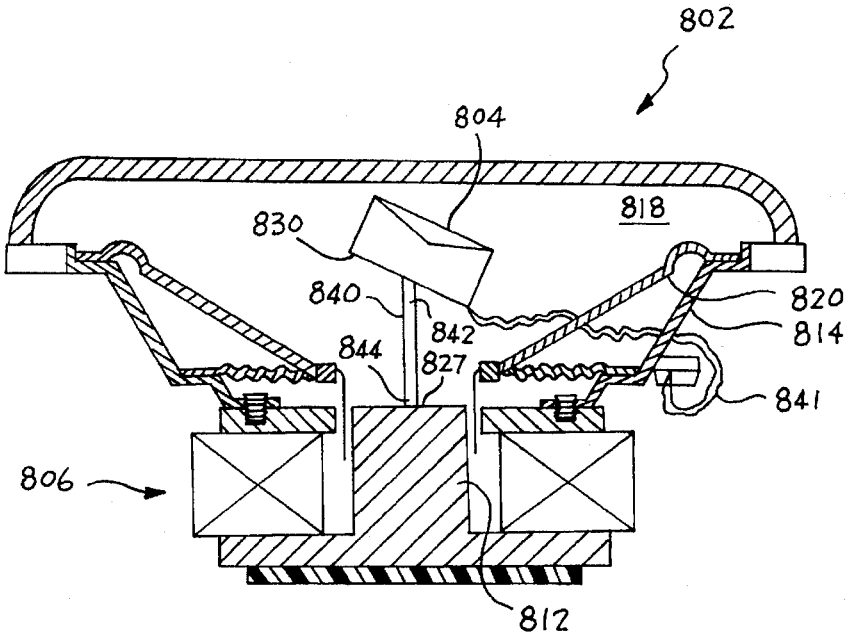
FIG. 10 is a cross-sectional view of still further another embodiment of the present invention composite speaker system, showing an adjustable arm means with one end fixedly mounted to a pole piece of a larger transducer and the other end pivotally mounted to a smaller transducer.

Referring to FIG. 10, there is shown at 802 a cross-sectional view of still further another embodiment of the present invention composite speaker system which represents a system of the coaxial, two way type configuration. It assembles and functions the same as previously described above in FIGS. 7 and 8 except that the elongated adjustable rod 840 is pivotally mounted to the smaller transducer 804 and fixedly mounted to the pole piece 812. All other components are the same as previously described in FIG. 7, and the description thereof will not be repeated and only the modified components will be described in detail. In this figure, the components are numbered correspondingly with 800 added to each number.

For simplicity of this embodiment, the pole piece 812 of the larger transducer 806 does not have a central opening therethrough, as shown in FIG. 7. However, the pole piece 812 may be produced as shown in FIG. 7. Electrical wires 841 are electrically connected by passing through the diaphragm 820 and the frame 814 of the larger transducer 806 in the conventional way and connected to input terminals of the larger transducer 806.

An elongated rod 840 comprises one end 844 fixedly attached to top 827 of the pole piece 812 and the other end 842 pivotally mounted to a back side 830 of the smaller transducer 804.

Defined in detail, the present invention is a speaker system for vehicles, comprising: (a) a larger transducer for reproducing low frequency sounds and having a bottom plate, a top plate a diaphragm, a damper, a pole piece extending from the bottom plate and a frame fixedly secured to the top plate, the damper having an outer edge mounted to the frame and an inner edge coupled to an inner edge of the diaphragm, the damper and the diaphragm mounted within an open space of the frame such that their inner edges form a central opening; (b) the pole piece having an aperture therein; (c) a smaller transducer for reproducing high frequency sounds and having a back side with a socket joint connection; (d) an elongated adjustable rod having a bottom end attached to top of the pole piece and a top ball joint end adjustably attached to the socket joint connection on the back side of the smaller transducer, where the elongated adjustable rod extends through the central opening formed by the diaphragm and the damper of the larger transducer and the smaller transducer is located within the open space such that the smaller transducer can be adjusted in any direction; and (e) a grill member detachably mounted on the periphery of the frame for covering the smaller transducer and the open space of the frame of the larger transducer; (f) whereby the smaller transducer can be adjusted in any direction for providing an aiming capability, thereby giving a listener up-front and live-performance sound.

Defined alternatively in detail, the present invention is a speaker system for vehicles, comprising: (a) a larger transducer for reproducing low frequency sounds and having a bottom plate, a top plate, a diaphragm, a damper, a pole piece extending from the bottom plate and a frame fixedly secured to the top plate, the damper having an outer edge mounted to the frame and an inner edge coupled to an inner edge of the diaphragm, the damper and the diaphragm mounted within an open space of the frame such that their inner edges form a central opening; (b) the pole piece having a socket joint connection; (c) a smaller transducer for reproducing high frequency sounds and having a back side with a socket joint connection; and (d) an elongated adjustable rod having two ball joint ends, each ball joint end adjustably attached to the socket joint connections of the smaller transducer and the pole piece respectively, where the elongated adjustable rod extends through the central opening formed by the diaphragm and the damper of the larger transducer and the smaller transducer is located within the open space such that the smaller transducer can be adjusted in any direction; (e) whereby the smaller transducer can be adjusted in any direction for providing an aiming capability, thereby giving a listener up-front and live-performance sound.

Defined broadly, the present invention is a speaker system having a first transducer for reproducing low frequency sounds and a second transducer for reproducing high frequency sounds, the first transducer having a bottom plate, a top plate, a diaphragm, a damper, a pole piece extending from the bottom plate and a frame fixedly secured to the top plate, the damper having an inner edge coupled to an inner edge of the diaphragm, the damper and the diaphragm mounted within an open space of the frame such that their inner edges form an opening, the speaker system comprising: (a) an adjustable rod having two ends, one of the two ends fixedly attached to one of the pole piece and the second transducer and the other one of the two ends adjustably attached through a ball joint connection to the other one of the pole piece and the second transducer, where the adjustable rod extends through the opening formed by the diaphragm and the damper of the first transducer and the second transducer is located within the open space such that the second transducer can be adjusted in a desired direction; (b) whereby the second transducer can be adjusted in any direction for providing an aiming capability, thereby giving a listener up-front and live-performance sound.

Defined more broadly, the present invention is a speaker system having a first transducer and at least one second transducer, the first transducer having a plate, a pole piece, a frame mounted to the plate and a diaphragm mounted within an open space of the frame, the diaphragm having a central opening, the speaker system comprising: (a) a rod means having one end attached to the pole piece and the other end attached to the at least one second transducer, where the rod means extends through the central opening of the diaphragm of the first transducer and the at least one second transducer is located within the open space, and where the at least one second transducer is adjusted in a desired direction; (b) whereby the at least one second transducer can be adjusted in any direction for providing an aiming capability, thereby giving a listener up-front and live-performance sound.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A speaker system for vehicles, comprising:

a. a larger transducer for reproducing low frequency sounds and having a bottom plate, a top plate, a diaphragm, a damper, a pole piece extending from the bottom plate and a frame fixedly secured to the top plate, the damper having an outer edge mounted to the frame and an inner edge coupled to an inner edge of the diaphragm, the damper and the diaphragm mounted within an open space of the frame such that their inner edges form a central opening;

b. said pole piece having an aperture therein;

c. a smaller transducer for reproducing high frequency sounds and having a back side with a socket joint connection;

d. an elongated adjustable rod having a bottom end attached to top of said pole piece and a top ball joint end adjustably attached to said socket joint connection on said back side of said smaller transducer, where the elongated adjustable rod extends through said central opening formed by said diaphragm and said damper of said larger transducer and said smaller transducer is located within said open space such that said smaller transducer is adjusted in any direction; and e. a grill member detachably mounted on the periphery of said frame for covering said smaller transducer and said open space of said frame of said larger transducer;

f. whereby said smaller transducer is adjusted in any direction for providing an aiming capability.

2. A speaker system for vehicles, comprising:

a. a larger transducer for reproducing low frequency sounds and having a bottom plate, a top plate, a diaphragm, a damper, a pole piece extending from the bottom plate and a frame fixedly secured to the top plate, the damper having an outer edge mounted to the frame and an inner edge coupled to an inner edge of the diaphragm, the damper and the diaphragm mounted within an open space of the frame such that their inner edges form a central opening;

b. said pole piece having a socket joint connection;

c. a smaller transducer for reproducing high frequency sounds and having a back side with a socket joint connection; and d. an elongated adjustable rod having two ball joint ends, each ball joint end adjustably attached to said socket joint connections of said smaller transducer and said pole piece respectively, where the elongated adjustable rod extends through said central opening formed by said diaphragm and said damper of said larger transducer and said smaller transducer is located within said open space such that said smaller transducer is adjusted in any direction;

e. whereby said smaller transducer is adjusted in any direction for providing an aiming capability.

3. The speaker system in accordance with claim 2 further comprising a grill member detachably mounted on the periphery of said frame for covering said smaller transducer and said open space of said frame of said larger transducer.

4. A speaker system having a first transducer for reproducing low frequency sounds and a second transducer for reproducing high frequency sounds, the first transducer having a bottom plate, a top plate, a diaphragm, a damper, a pole piece extending from the bottom plate and a frame fixedly secured to the top plate, the damper having an inner edge coupled to an inner edge of the diaphragm, the damper and the diaphragm mounted within an open space of the frame such that their inner edges form an opening, the speaker system comprising:

a. an adjustable rod having one end fixedly attached to one of said pole piece and said second transducer and the other end adjustably attached through a ball joint connection to one of said pole piece and said second transducer, where the adjustable rod extends through said opening formed by said diaphragm and said damper of said first transducer and said second transducer is located within said open space such that said second transducer is adjusted in any direction;

b. whereby said second transducer is adjusted in any direction for providing an aiming capability.

5. The speaker system in accordance with claim 4 further comprising a grill member detachably mounted on the periphery of said frame for covering said second transducer and said open space of said frame of said first transducer.

6. A speaker system having a first transducer and at least one second transducer, the first transducer having a plate, a pole piece, a frame mounted to the plate and a diaphragm mounted within an open space of the frame, the diaphragm having a central opening, the speaker system comprising:

a. a rod having one end attached to said pole piece and the other end attached to said at least one second transducer, where the rod extends through said central opening of said diaphragm of said first transducer and said at least one second transducer is located within said open space, and where said at least one second transducer is adjusted in a desired direction;

b. whereby said at least one second transducer is adjusted in any direction for providing an aiming capability.

7. The speaker system in accordance with claim 6 further comprising a grill member detachably mounted on said frame for covering said at least one second transducer and said open space of said frame of said first transducer.

8. The speaker system in accordance with claim 6 wherein said one end of said rod is a ball joint end adjustably attached to said at least one second transducer.

9. The speaker system in accordance with claim 6 wherein said other end of said rod is a ball joint end adjustably mounted to said pole piece.

10. The speaker system in accordance with claim 6 wherein said one end and said other end of said rod are ball joint ends adjustably mounted to said pole piece and said at least one second transducer respectively.

11. The speaker system in accordance with claim 6 wherein said one end of said rod is pivotally attached to said at least one second transducer.

12. The speaker system in accordance with claim 6 wherein said first transducer is a woofer.

13. The speaker system in accordance with claim 6 wherein said at least one second transducer is a tweeter.

14. The speaker system in accordance with claim 6 wherein said at least one second transducer is a midrange.

* * * * *